United States Patent [19]

Ozawa

[11] Patent Number: 4,549,083

[45] Date of Patent: Oct. 22, 1985

[54] X-RAY IMAGING DEVICE FOR DIRECTLY DISPLAYING X-RAY IMAGES

[75] Inventor: Lyuji Ozawa, Glencoe, Ill.

[73] Assignee: Matsushita Electric Industrial Co., Ltd., Osaka, Japan

[21] Appl. No.: 496,627

[22] Filed: May 20, 1983

[30] Foreign Application Priority Data

Jun. 10, 1982 [JP] Japan ..... 57-100239
Jun. 10, 1982 [JP] Japan ..... 57-100240

[51] Int. Cl.[4] ..... G21K 4/00; H01J 31/50
[52] U.S. Cl. ..... 250/458.1; 250/484.1
[58] Field of Search ..... 250/458.1, 483.1, 484.1, 250/327.2, 213 VT; 378/62

[56] References Cited

U.S. PATENT DOCUMENTS 3,484,752 12/1969 Kallmann ..... 250/327.2 X
3,617,743 11/1971 Rabatin et al. ..... 250/213 VT X
3,655,978 4/1972 Faria et al. ..... 250/483.1
4,297,584 10/1981 Buchanan et al. ..... 250/483.1
4,421,671 12/1983 Cusano et al. ..... 252/301.4 F

OTHER PUBLICATIONS

Lyuji Ozawa, "Hysteresis in the Voltage Dependence of Cathodoluminescence", *Appl. Phys. Lett.*, vol. 43, No. 11, (Dec. 1983), pp. 1073–1074.

Lyuji Ozawa and Shigeru Hayakawa, "A Study on Cathodoluminescence Intensities in the Range Below 3 kV", *Journal of Luminescence*, vol. 28, (1983), pp. 327–335.

*Primary Examiner*—Alfred E. Smith
*Assistant Examiner*—Constantine Hannaher
*Attorney, Agent, or Firm*—Wenderoth, Lind & Ponack

[57] ABSTRACT

A device for directly displaying X-ray images on a phosphor screen of a cathode ray tube by means of a steady cathodoluminescence is arranged such that the excitation of the phosphor screen is controlled by the persistent polarization and depolarization of the phosphor crystals in the phosphor screen by exposure to X-rays. The X-ray images formed on the phosphor screen in the cathode ray tube may be read out by synchronously detecting changes in the electric current of the collecting electrodes of the tube during the scanning of a reading electron beam on the phosphor screen displaying the X-ray images.

20 Claims, 13 Drawing Figures

X-RAY IMAGING DEVICE FOR DIRECTLY DISPLAYING X-RAY IMAGES

BACKGROUND OF THE INVENTION

An X-ray is an electromagnetic wave having a high energy which has a power to penetrate through many materials, e.g.- a human body, packed materials, industrial products and the like, and a transmitted X-ray has a space distribution in its intensity due to the difference in the absorption coefficients in the materials. If our eyes had the ability to see X-rays, we would be able to see the space distribution of the transmitted X-rays, i.e.- the inside of the materials. Unfortunately, our eyes cannot detect X-rays. To observe the inside of the materials, a conversion from X-rays to another media, which can be observed with our eyes, is absolutely necessary. However, there is no available three dimensional image detector, and a transmitted X-ray is usually projected on a two dimensional plane (e.g.- a screen), which detects X-rays, so as to observe the inside of the materials. A typical X-ray detecting screen is an X-ray film which is coated with an X-ray sensitive emulsion of a suspended fine powder of silver halides. When the X-ray film has been exposed to X-rays, a latent X-ray image is formed in the X-ray film and the exposed film is chemically developed in a darkroom to semi-permanently fix the X-ray image on the X-ray film. The developed X-ray film has different reflections (or transmittances) with respect to light, e.g.- dark portions correspond to exposed areas and light portions correspond to unexposed areas. Thus, doctors in hospitals can diagnose the inside of a body by observing the developed X-ray film under a light or by transmitted light, and the inspectors in industrial processes and security areas can nondestructively inspect the inside of materials of industrial products and packages. Thus, the X-ray images are essential for enabling doctors in hospitals and clinics to diagnose patients, and for enabling inspectors to inspect the products in quality control areas of industry, and for enabling security guards to inspect packages in security areas.

Because X-ray film has a poor sensitivity to X-ray exposure, a large dosage of X-rays to a patient's body is needed for the formation of a proper X-ray image on the X-ray film for use in diagnostic purposes by doctors. The large dosage of X-rays to a body is hazardous and sometimes causes severe damage to the health of patients. The reduction of the dosage of the exposure of X-rays to the human body is a primary subject for radiologists. A successful approach is an application of a fluorescent intensifier screen which converts X-rays to a fluorescent light in the wavelengths of the maximum senstivity of X-ray film, noting that X-ray film is more sensitive in the near ultraviolet light range in comparison to X-rays. If the fluorescent intensifier screen is attached to the X-ray film, then the X-ray film absorbs both X-rays and fluorescent light; naturally, the formation of the X-ray image on the X-ray film is significantly improved. The fluorescent intensifier screen is coated with phosphor crystals which have a high absorption coefficient of X-rays and a high conversion efficiency of luminescence. However, the application of the fluorescence intensifier screen does not eliminate the essential difficulties of the use of X-ray film. They are: the need for a chemical process in a darkroom; the need for a treatment of the image information to enhance the objective images on the X-ray film; and storage of the developed X-ray films.

The X-ray image intensifier tube, i.e.- a special cathode ray tube consisting of a layer that emits photoelectrons as X-rays are absorbed, and electrodes for accelerating the photoelectrons, and electric lenses and a phosphor screen which emits cathodoluminescence when the accelerated photoelectrons hit the phosphor screen, has been developed to eliminate the need for a process in a darkroom. The X-ray image intensifier tube detects a small limited area of the body, and the X-ray image on the phosphor screen is only observed during the exposure of X-rays to the body. This increases the X-ray exposure dosage on the body which is needed for diagnosis by doctors. The permanent or semi-permanent recording of the X-ray image on a screen may therefore reduce the X-ray exposure dosage on the body.

There has been an attempt to record the X-ray image on the phosphor screen, that is, a phosphor screen utilizing thermoluminescence. Some phosphors emit thermoluminescence if the phosphors which are exposed to X-ray radiation are heated to an elevated temperature by either irradiation by an infrared light or by a laser beam which is focused on the exposed screen. However, the sensitivity to X-rays and intensity of thermoluminescence are not high enough to obtain a sharp image. A more practical device utilizes an electrostatic image formed on the dielectric layer. The dielectric layer is charged as the electric field has been applied, and the charged layer is discharged as X-rays irradiate the charged layer. The sensitivity of such a device is not high enough for a wide application to radiology, limiting the application of such a device.

SUMMARY OF THE INVENTION

The object of this invention is to provide a cathode ray tube which can display X-ray images on a phosphor screen. In more detail, the present invention relates to a phosphor screen in a cathode ray tube which has no cathodoluminescence if the phosphor crystals in the phosphor screen are persistently polarized, and in which the phosphor screen emits steady cathodoluminescence if the phosphor crystals in the screen are depolarized. In the cathode ray tube of the present invention, the phosphor crystals in the phosphor screen are persistently polarized by an external electric field which has been applied across the phosphor screen, and the persistently polarized crystals in the screen are then depolarized by the irradiation of X-rays. Hence, when X-rays which are trasmitted through a human body or materials irradiate the persistently polarized phosphor crystals arranged on the phosphor screen in the cathode ray tube of the present invention, the phosphor screen displays an X-ray image on the screen with a steady cathodoluminescence. The cathode ray picture tube of the present invention essentially consists of: (a) -an envelope which keeps the inside of the tube at a high vacuum; (b) -an electrically conductive and optically transparent face plate which has a low absorption coefficient with respect to X-ray radiation; (c) -a phosphor screen formed on the inside of the face plate; (d) -a reading gun which supplies a sharply focused high energy electron beam; (e) -flood guns which steadily supply low evergy electrons, showering them uniformly throughout the phosphor screen; and (f) -electrodes for collecting both electrons repulsed from the phosphor screen and secondary electrons emitted from the phosphor crystals. In the picture tube of the present invention, the penetration of the low energy electrons from the flood guns into phosphor crystals, giving rise to the cathodoluminescence from the phosphor screen, is controlled by means of the persistent polarization and depolarization of the phosphor crystals.

DESCRIPTION OF THE PREFERRED EMBODIMENT

Figure 1:
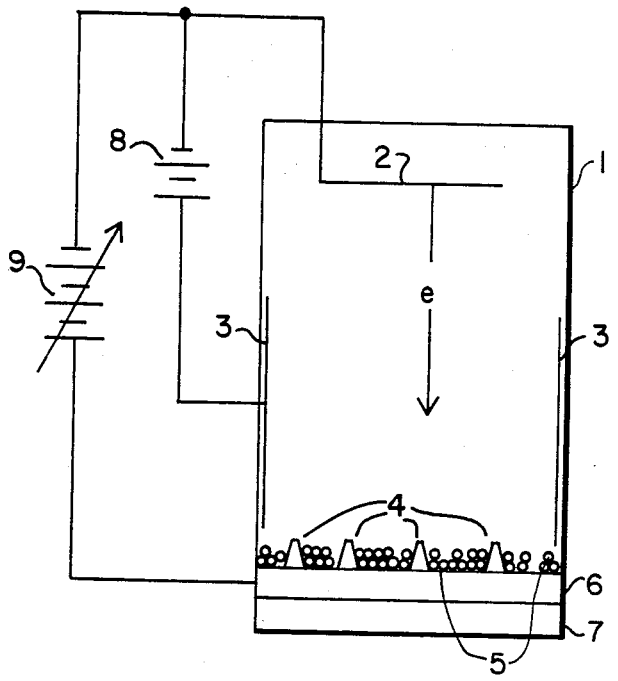
FIG. 1 shows a schematic illustration of a cathode ray tube for measuring the voltage dependence curve in a voltage range below 1,000 volts of cathodoluminescence intensities of phosphor crystals having a clean surface, wherein element 1 is a glass envelope; element 2 is a cathode; elements 3 are first collecting electrodes; elements 4 are second collecting electrodes; element 5 is a phosphor screen; element 6 is an optically transparent and electrically conductive film; element 7 is a face plate; element 8 is a power supply; element 9 is a variable power supply.

A phosphor screen in a cathode ray tube consists of tiny phosphor crystals having a size of around 5 to 10 micrometers. The crystals emit cathodoluminescence when an electron beam from the tube cathode has penetrated into the phosphor crystals and as a consequence thereof, a part of the energy from the penetrated electrons is converted to the energy of emitted photons (i.e. cathodoluminescence). Therefore, to understand cathodoluminescence from the phosphor screen, a comprehension of the mechanisms involved in the energy loss of the penetrating electrons in the phosphor crystals is essential.

When a crystal is irradiated by an electron beam, a large part of the incident electrons penetrate into the crystal, and the residual electrons are ejected from the crystal surface (e.g. -backscattered primary electrons which are due to the elastic scattering with the lattice ions which are arranged in the surface layers of the crystal). The penetrating electrons lose their energy by elastic and inelastic collisions with the lattice ions along the electron trajectories, generating X-rays, Auger electrons, secondary electrons, electron-hole pairs, and phonons. The secondary electrons and scattered incident electrons form the electron gas plasma in the crystal and the lattice ions are excited by the electron-plasmon interaction to produce other secondary electrons having an energy which is smaller than that of the interaction electrons. Therefore, under the irradiation of the electron beam from the tube cathode on the crystal, the electrons in the ground states of the lattice ions may be directly excited into their higher energy states (excited states) by the collision with the incident electrons and the internally generated secondary electrons. The electrons in the excited states return to their ground states by emitting photons (i.e. -a radiative transition) and/or phonons (i.e. -a nonradiative transition). Phosphor crystals contain radiative transition centers, which are referred to as "activators", so that the phosphor crystals emit cathodoluminescence under the irradiation of an electron beam.

The activators in some crystals are also indirectly excited through the recombination of electrons and holes generated in the crystal by the penetrated electrons. Under the given condition of the irradiation of electrons on the phosphor crystals, the number of direct excitations of the activators in the penetration volume is negligibly small as compared to the number of electrons and holes generated in the crystals. It follows that the indirect excitation of activators results in a brilliant cathodoluminescence intensity and the direct excitation of the activators results in a weak cathodoluminescence intensity. The phosphor crystals containing activators of the recombination of electrons and holes are widely used in practical cathode ray picture tubes to obtain a brilliant cathodoluminescence.

Hence, the brightness of the cathodoluminescence from the phosphor screen in a practical cathode ray tube is proportional to the number of the recombinations of electrons and holes which are generated in the crystal by the irradiation of an electron beam from the tube cathode. The number n of the pairs of electrons and holes generated in the crystal by the irradiation of the electron beam is given by:

$$n=kW \quad (1)$$

where W is the energy dumped in the crystal and k is constant. W is given by the product of the accelerating voltage V of the electrons from the tube cathode and the electron beam density on the phosphor crystal. If the beam density on the phosphor crystal is constant, W (corresponding to n) is expressed by a linear function of the accelerating voltage V of the electron beam. It follows that under the condition that the electron beam density is constant, the brightness of the cathodoluminescence should be proportional to the accelerating voltage of the electron beam (i.e. -the voltage dependence curve of cathodoluminescence). It can be said, therefore, that when the electron beam has penetrated into the phosphor crystals, the intensity of cathodoluminescence shold be linear with respect to the accelerating voltage (V).

A study of the voltage dependence curve of cathodoluminescence intensities was made with the phosphor screen in a demountable cathode-ray tube configuration as shown in FIG. 1. The phosphor crystals forming the screen lie on the face plate (substrate 6) which is transparent for luminescence viewing. With the phosphor screen prepared by ordinary methods, one obtains a linear dependence of cathodoluminescence intensities in the voltage range above 3 kV and, in the voltage range below 3 kV, the faint cathodoluminescence intensities, which deviate from the linear relationship, are obtained. The voltage of the extrapolated point of the intersection of the linear dependence curve to the abscissa of the voltage dependence curve (about 2 kV) is referred to as the "dead voltage". The dead voltage is not dependent on the type of phosphors or on the degree of chemical etching of the crystals.

After extensive and careful study has been carried out on the voltage dependence curves of cathodoluminescence, it has been found that the dead voltage at 2 kV is not caused by the characteristic properties of the phosphor crystal itself but originates from foreign materials which are affixed to the surface of the phosphor crystals or from a thin film of the foreign materials which cover the phosphor crystals. In the voltage range below 2 kV, the characteristic properties of the phosphor crystals are concealed in the properties of the foreign materials on the surface of phosphor crystals, which are induced by the irradiation of the electron beam. The foreign materials affixed to or covering the surface of the phosphor crystals come from (a) the binder used in the screening process of applying the phosphor crystals to the cathode ray picture tube, (b) the materials deliberately coated on the crystals to improve the screen quality, and (c) the chemical contamination of the surface in a few atomic layers during the crystallization of the crystals, or by the exposure of the crystals in an air atmosphere during the production of the tube. When the foreign materials have been removed from the surface of the phosphor crystals, the intensities of the cathodoluminescence are linear with respect to the accelerating voltage in the voltage range below 3 kV, and the threshold voltage of the cathodoluminescence falls in the range of around a few hundred volts, depending on the phosphor crystals. Before explaining the low threshold voltage of phosphor crystals which have a clean surface, the effects of the foreign materials induced by the irradiation of the electrons on the concealment of the characteristic voltage dependence curve of the phosphor crystals must be clarified in order to more easily understand the present invention.

The concealing mechanisms by the foreign materials on the surface of phosphor crystals can be explained as follows: As already described, the penetrating electrons lose their energy by elastic and inelastic collisions with the ions in the materials, with single and/or multiple scattering models, along the electron trajectories, generating X-rays, Auger electrons, secondary electrons, electron-hole pairs, and phonons. The ions in the materials are excited not only by the incident electrons but also by the internally generated secondary electrons. It is known that the internally generated secondary electrons and scattered incident primary electrons form an electron gas plasma in the crystal, and the lattice ions are also excited by the electron-plasmon interaction to produce other secondary electrons having an energy which is smaller than that of the interaction electron. The mean free path of the plasma electrons (i.e. -the average distance which an electron travels in the crystal without a collision) depends on the energy of the plasma electrons, and can be theoretically calculated from an equation. In an ordinary cathode ray tube, the mean-free path is about 10 Å, which is equivalent to three to five crystal lattice distances, depending on the materials used. Hence, only the secondary electrons generated in the surface volume at a depth which is smaller than the mean-free path can escape from the crystal surface, giving rise to secondary electrons which can be collected in front of the crystal. The secondary electrons which are collected in front of the crystal surface have an energy which is smaller than 50 electron volts, and are referred to as "true secondary electrons" as distinguished from the secondary electrons which cannot escape from the crystal and from the backscattered primary electrons. Each collision of a plasma electron with an ion produces one secondary electron.

The probability that one penetrating electron collides with the lattice can be calculated by a Monte Carlo technique. The calculation shows that an incident electron, including a secondary electron generated in the crystal, collides a few times with the ions in a surface volume which is shallower than the mean-free path (i.e. -one entered electron may produce a few true secondary electrons). This means that the ratio ($\delta$) of the true secondary electrons to the entered electrons is always greater than one when the incident electron has penetrated into the crystal. The reported experimental $\delta$-values for a given crystal are nearly constant with respect to the accelerating voltage, thereby supporting the model described above. Thus, the hypothesis that the δ-values of the true secondary electrons are smaller than one in some voltage range, which has traditionally been believed, is incorrect.

The ejection of true secondary electrons from the material leaves holes in the surface volume of the material, and the number of holes left is in accordance with the number of true secondary electrons ejected. Therefore, when the incident electrons have penetrated into the material, the material holds the positive charges (holes) in the surface volume on the irradiation side, with the result that more electrons (i.e. -true secondary electrons) are ejected from the material than electrons which have entered ($\delta > 1$). The positive field produced by the holes may extend outside the material (in a vacuum) and attracts the true secondary electrons and backscattered electrons. If the electrons have insufficient energy to re-enter the material, the electrons may be bound at a short distance from the material surface by an electrostatic force, and the bound electrons do not move from the surface of the material. These electrons which are fixed in front of the material are called as "surface-bound-electrons". The surface-bound-electrons are instantly formed in front of the material when the incident electrons have entered. If the irradiated material is observed from the gun side, the material is apparently covered with a negatively charged electron cloud (i.e.- the surface-bound-electrons). If one merely pays attention to the surface-bound-electrons forming in front of the material, regardless of the binding force, the surface-bound-electrons will be observed as an "electron cloud" formed in front of the material. In reality, the surface-bound-electrons always need the binding pairs that are the holes in the surface volume of the material, and they are tightly bound each other against the material surface (i.e.- the boundary of the material and a vacuum).

Since the foreign material is uniformly distributed on the surface of the phosphor crystals, the negative field produced by the surface-bound-electrons on the foreign material may be extended over the phosphor crystals and effectively shields the phosphor crystals. The negative shield prevents the low energy electron beam from reaching the phosphor crystals. Consequently, no luminescence would be observed with the low energy electron beam after the very short time during which the first incident electrons have penetrated into the foreign material. Electrons which have an energy which is large enough to penetrate through the shield reach the phosphor crystals and enter into the crystals, subsequently producing the brilliant cathodoluminescence. This gives rise to a constant threshold voltage (e.g.- 2 kV) for the penetration through the shield. The real voltage dependence curve of phosphors is thus concealed in the shielding by the surface-bound-electrons outside the foreign material covering the phosphor crystals in the range below 3 kV, and the nondependence of the threshold voltage on the type of phosphors, the etching of the crystals, and the concentrations of the binder can be explained by the concealment in the shield by the surface-bound-electrons on the foreign material.

With a macroscopic picture, the repulsion of the incident electrons from the phosphor crystals is a well known phenomena, and this has been interpreted for a long time as the charge-up of the phosphor crystals itself due to the smaller ratio of the true secondary electron emission. As already described above, this statement is incorrect. The crystal itself is never charged-up negatively under the irradiation of an electron beam. Rather, it is due to the surface-bound-electron, i.e.- the apparent electron cloud, formed in front of the foreign material. To observe the proper voltage dependence curve of cathodoluminescence from the phosphor screen, the phosphor crystals must have clean surfaces, and the contamination of the surfaces should be avoided in the preparation of phosphor crystals and in the tube fabrication.

Since the phosphor crystal itself is a good insulator (e.g. having a resistivity which is greater than $10^{10}$ ohm-cm) and also has surface-bound-electrons under the irradiation of an electron beam, a question arises as to why the phosphor crystals which have a clean surface exhibit a different voltage dependence curve from that of the contaminated phosphor crystals. This evidence shows how the surface-bound-electron formed on the phosphor crystals are removed from the surface of the phosphor crystal.

There are two possible ways to remove the surface-bound-electrons from the surface of the crystals. One possible way is the application of a positive field over the crystals. Since the surface-bound-electrons are very tightly bound in front of the crystals, the application of the positive field produced by the collecting electrodes is not large enough to remove the surface-bound-electrons. This has already been proven by the fact that the surface-bound-electrons formed on the surface cannot be removed by the field produced by the collecting electrodes. Another possible way is the elimination of the holes, which are binding pairs of the surface-bound-electrons from the surface volume. The surface-bound-electrons which lose the binding pairs (holes) are released from the surface of the crystal. The removal (or elimination) of the holes from the surface volume is easily achieved in the conductive material, which is connected to an external power source.

When the irradiation of an electron beam has been made on the conductive material, the true secondary electrons are emitted from the surface of the conductors, leaving the holes in the surface volume of the conductor. The true secondary electrons may be instantly attracted by the holes in the surface volume of the conductor to form the surface-bound-electrons. When the conductor is connected to an external power source, the electons are injected into the conductor from the power source through the connected electrode. The injected electrons which have a high mobility in the conductor, migrate into the conductive material and meet with the holes. Then, the electrons recombine with the holes in the surface volume of the conductor, thereby eliminating the holes in the surface volume of the conductor.

The surface-bound-electrons formed in front of the conductor, in the next moment, lose the binding pairs, and the electrons released from the surface are easily collected by the collecting electrodes. If the conductive material is disconnected from the power supply, the electrons are not injected into the conductor. Therefore, the holes in the surface volume remain in their generated places. Hence, the surface-bound-electrons may stay in front of the surface of the conductor and prevent the late arriving electrons from reaching the conductor. The repulsion of the incident electrons from the disconnected conductors is sometimes perceived as the charge up of the conductor.

The phosphor crystals are tiny crystals and each of these do not possess electrodes on the surface so as to make an ohmic contact with the conductive substrate. This means that the crystals in the phosphor screen are electrically isolated from each other and are also electrically disconnected, (i.e.- floating) from the conductive substrate. Therefore, there is no way to inject the electrons into the crystals from the conductive substrate or into the conductive substrate from the crystals. Therefore, the holes in the surface volume of the phosphor crystal cannot be eliminated by means of the injection of the carriers from the conductive substrate.

It has been found that if the phosphor crystals contain the recombination centers of electron-hole pairs, then the holes in the surface volume of the phosphor crystals are partially and/or totally eliminated from the surface volume when the electron-hole pairs are densely generated in the crystals. This is because the holes in the surface volume move in the crystal bulk in which the holes are recombined with the electrons at the activators during the high conductivity of the crystal. The phosphor crystal is usually an insulator, but becomes a highly conductive material during the time when the crystal contains a large amount of carriers. The conductivity of the phosphor crystals is proportional to the amount of the carriers (i.e.- electrons and holes) generated in the crystals, even though the individual carrier has a low mobility in the crystals. The conductivity is increased with an increase in the density of the carriers in the crystals. A high density of carriers is generated in the phosphor crystals under the irradiation of X-rays, electron beams and photons having an energy which is greater than the band gap of the phosphor crystals. When the phosphor crystals are conductive, the holes in the surface volume of the crystals may migrate into the bulk of the crystals. Ultimately, the holes are recombined with the electrons at the recombination centers of electron-hole pairs. Thus, the recombination of electrons and holes eliminates the carriers in the crystals. The density of the carriers generated in the crystal is decreased in time with termination of the irradiation of X-rays, electron beams or photons on the crystal, and thus the crystal ultimately becomes an insulator (i.e.- a low conductivity material). The important effect of the holes moving into the bulk from the surface volume is that a surface-bound-electron instantaneously loses its intimate binding pair (hole) and moves along the crystal surface to find another binding pair. If the electric field produced by the collecting electrodes are applied over the phosphor crystals, the surface-bound-electron which instantaneously loses the intimate binding pair may be removed from the surface of the phosphor crystal.

There are two kinds of recombination centers formed in the phosphor crystals; radiative recombination centers (i.e.- activators), and non-radiative recombination centers. In practical phosphors, the number of non-radiative recombination centers is minimized. It has been found that the recombination centers of electron-hole pairs form at the impurities (or crystal defects) which can change the valences, and the recombination process of electron hole pairs at the recombination centers is triggered with the first trapped carriers, either electrons or holes, depending on the recombination centers. The recombinations centers which are triggered with the capture of either an electron or hole effectively remove the holes in the surface volume of the phosphor crystals.

The surface-bound-electrons on the phosphor crystals which are arranged on the screen in an ordinary cathode ray tube are not completely removed from the surface of the phosphor crystals, and some surface-bound-electrons still remain on the surface of the phosphor crystals. To completely remove the surface-bound-electrons from the phosphor crystals, it is necessary that the phosphor crystals are screened in a special cathode ray tube having the configuration shown in FIG. 1. Using this tube configuration, a good result is obtained with respect to removing the surface-bound-electrons with a screen thickness of between two and five layers (average) of the phosphor crystals on the optically transparent and electrically conductive face plate. With thicker screens of more than 5 layers, the surface-bound-electrons partially remain on the phosphor crystals, and the amount of the remaining surface-bound-electrons is progressively increased with an increase in the number of layers of phosphor crystals. When the screen is thicker than 1 mm, the surface-bound-electrons are no longer removed from the screen.

It has been found that if a metal mesh which has an electrical potential which is equal to that of the conductive face plate is placed in front of the phosphor screen or a part of the bottom of the metal mesh is embedded in the phosphor screen, the surface-bound-electrons are always completely removed from the surface of the phosphor crystals, even with the thicker screen layers. However, the transmitted luminescence intensities from the phosphor screen is decreased with increase in the screen thickness and the optimum thickness always lies between 2 and 5 layers.

Figure 2:
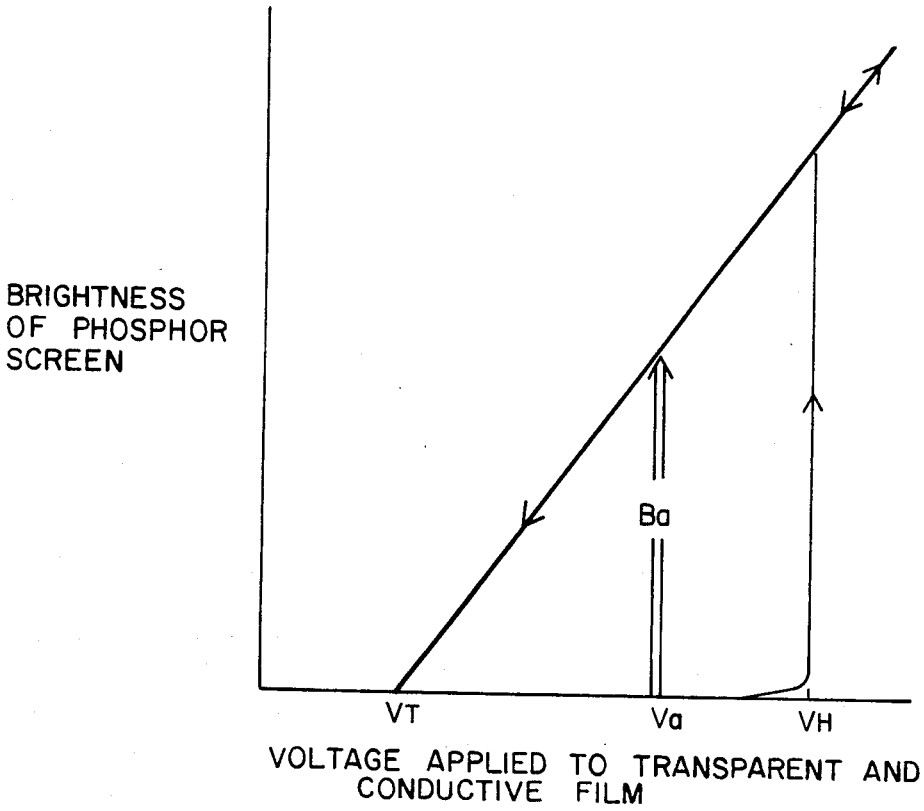
FIG. 2 shows a hysteresis effect which appears in the voltage dependence curve of the cathodoluminescence intensities of phosphor crystals having clean surfaces.

If the measurements of the voltage dependence curve of the cathodoluminescence intensities are made with the phosphor screen in the cathode ray tube shown in FIG. 1, the voltage dependence curve of the phosphor crystals having the clean surface exhibits the hysteresis effect as shown in FIG. 2 in the voltage range just above the threshold after a negative field (e.g. −250 volt) has been applied across the phosphor crystals. The hysteresis is observed only with the following procedure: after a negative potential has been applied to the conductive film 6, the potential of the conductive film 6 is gradually increased from zero with respect to the cathode potential. No luminescence is observed below $V_T$ in FIG. 2. At a further increase in the voltage beyond $V_T$, the cathodoluminescence intensity gradually increases up to $V_H$. Above $V_H$, the cathodoluminescence intensity suddenly jumps up and reaches the linear dependence which is expressed by Eq. (1). Once the phosphor screen has been irradiated with electrons having an energy which is greater than $V_H$, the cathodoluminescence intensities are linear with an accelerating voltage of the voltage range above $V_T$ and the hysteresis around $V_H$ is not observed. The application of the negative potential to the conductive film is an essential necessity to observe $V_H$. Once the negative potential has been applied to the conductive film 6, the hysteresis is observed once in the voltage dependence curve of the cathodoluminescence intensities if the surface of the phosphor crystals is clean. Thus, the hysteresis is reproduceable with the application of the negative potential to the conductive film 6.

It has been found that the hysteresis is caused by the persistent polarization and depolarization of the phosphor crystals. Insulators are always polarized when an electric field is applied across the crystal, and are depolarized when the electric field is removed from the crystal. The phosphor crystals used in this invention differ from regular insulators in that they hold their polarization after the removal of the electric field from the crystals, i.e.- they exhibit a persistent polarization. This remaining polarization is called a persistent polarization or a persistent internal polarization. The polarity of the persistent polarization corresponds to the polarity of the applied field across the crystal. The mechanisms involved in the persistent polarization are not clearly understood. An explanation of the persistent polarization is that the phosphor crystals usually contain trapped electrons and holes. When an electric field is applied to the crystals, the electrons and holes are released from the traps, and migrate in the crystals according to the electric field. The electrons are trapped in the deep electron traps distributing on one side of the crystal, and the holes are trapped in the deep hole traps on the other side of the crystal. The separately trapped carriers may give rise to the persistent polarization.

The persistent polarization is depolarized when X-rays, electrons having an energy which is greater than $V_H$, or photons having an energy which is greater than the band gap of the phosphor crystals are irradiated on the persistently polarized crystals, and as a result thereof, carriers are generated in the crystals, resulting in an increase in their conductivity. The persistent polarization, however, is not depolarized under irradiation of either electrons having an energy which is smaller than $V_H$ or photons having an energy which is smaller than the band gap of the crystals. This invention utilizes the hysteresis appearing in the voltage dependence curve of cathodoluminescence intensities caused by the persistent polarization and depolarization of the phosphor crystals.

If the surface of the phosphor crystals is clean and if the crystals show persistent polarization, the phosphor crystals in the phosphor screen may persistently have negative charges on the gun side when a negative potential has been applied to the conductive films. The negative charges on the gun side of the phosphor crystals produce a negative field which prevents the low energy electrons from reaching the phosphor crystals. An electron beam having an energy which is large enough to penetrate through the negative field produced by the persistent polarization can penetrate into the phosphor crystals and cause the depolarization of the persistently polarized phosphor crystals if the proper amount of energy is dumped on the phosphor crystals.

The persistent polarization and its polarity effect on the phosphor screen can be separately determined experimentally by measuring the surface potential of the phosphor screen after negative and positive electric potentials have been respectively applied to the phosphor screen. When a negative potential has been applied to the phosphor screen, the negative surface potential is detected on the surface of the phosphor screen, and a positive surface potential is detected when a positive potential has been applied to the phosphor screen. The depolarization can be detected by measuring the surface potential of the phosphor screen. After confirming that the phosphor screen holds a persistent polarization, X-rays or electrons having an energy which is greater than $V_H$ are irradiated on the entire area of the persistently polarized phosphor screen. No surface potential is detected on the irradiated phosphor screen. Thus, persistent polarization and depolarization of the phosphor screen are in accordance with the hysteresis which has appeared in the voltage dependence curve of the cathodoluminescence.

Many cathodoluminescent phosphors exhibit a persistent polarization when an electric field has been applied, and the depolarization occurs as X-rays, or electron beams having a high energy irradiate the persistently polarized crystals, and also show a hysteresis effect in the voltage dependence curve of their cathodoluminescence intensities if the surface of the phosphor crystal in the screen is not contaminated with foreign materials. Such phosphors may be, for example, zinc sulfide phosphors activated with copper or silver and coactivated with chlorine or aluminum. A part of the zinc in the above phosphors can be replaced by cadmium sulfide phosphors. Other phosphors are: the oxysulfides and oxyhalides of yttrium, gadolinium, and lanthanum, which are activated with, at least, one of the elements from the group of cerium, terbium, europium, dysprosium, samarium and praseodymium; the oxides of yttrium, gadolirium, and lanthanum which are activated with, at least, one of the elements from the group of europium, samarium and dysprosium; the sulfides, silicates and phosphates of zinc which are activated with manganese.

For application of the sulfides to the phosphor screen in cathode ray picture tube, contamination of the surface should be avoided in the tube production process. The surface of the sulfides are chemically unstable in air, especially with moisture and at elevated temperature. The surface layers of the sulfides are easily oxidized during the production of the tube, and the surface layer chemically converts to the compounds containing oxygen (i.e.- a contaminated layer) in which the recombination centers in the bulk no longer act as the recombination centers of electron hole pairs. If the surface of the sulfides in the phosphor screen is kept clean, the sulfides show a persistent polarization after the electric field has been applied across the crystals, and the polarized crystals are depolarized by exposure to X-rays or high energy electrons. Therefore, the sulfides show a hysteresis in the voltage dependence curve of their cathodoluminescence intensities.

A cathode ray tube in accordance with the present invention which is able to display X-ray images essentially utilizes the hysteresis appearing in the voltage dependence curve of cathodoluminescence intensities and makes an X-ray image on the phosphor screen by the steady cathodoluminescence which is visually perceived without an irritating flicker. Such an X-ray image device also utilizes the secondary electrons from the phosphor crystals for reading the X-ray images formed on the phosphor screen. The details of the formation mechanisms of the X-ray images on the phosphor screen are first explained below, referring the device which is schematically shown in FIG. 1.

The phosphor crystals which have a clean surface are screened to a thickness of around 20 micrometers on the electrically conductive layer 6 formed on the face plate 7 without a binder. For a cathode ray tube in accordance with the present invention, the face plate 7 and electrically conductive layer 6 are optically transparent for the X-ray image viewers and the face plate 7 must have small absorption coefficient with respect to X-rays so as to reduce the absorption (ideally no absorption) of the X-rays by the face plate 7. Thus, more X-rays penetrate through the face plate 7 and conductive layer 6, and reach the phosphor crystals 5 where the persistently polarized phosphor crystals are depolarized by the absorbed X-rays, eventually overcoming the hysteresis appearing in the voltage dependence curve of cathodoluminescence intensity. In such an X-ray image device, the electrons from the cathode 2 are defocused and are uniformly irradiated throughout the phosphor screen 5. Therefore, the phosphor screen emits cathodoluminescence if the phosphor crystals are not persistently polarized. The phosphor crystals 5 on the conductive film 6 have a persistent polarization with the negative polarity on the gun side, when a negative potential has been applied to the conductive film 6. Then, the phosphor crystals emit no cathodoluminescence. A potential between $V_T$ and $V_H$, e.g.- $V_a$, is applied to the conductive film 6. The electrons from the cathode 2 are accelerated by a potential $V_a$ which does not have enough energy to penetrate through the negative field produced by the persistent polarization, and the electrons are repulsed from the negative field. The repulsed electrons are collected by the collecting electrodes 3, and the phosphor screen has no cathodoluminescence. When the persistently polarized phosphor crystals arranged on an area of the phosphor screen 5 are exposed to X-rays, the persistently polarized crystals arranged on the exposed area are depolarized and allow the electrons from cathode 2 to reach the phosphor crystals. Ultimately, the exposed area of the phosphor screen emits cathodoluminescence of the intensity $B_a$ as shown in FIG. 2. If the phosphor screen 5 of the persistently polarized crystals is exposed to X-rays transmitted from the body or materials, the phosphor screen 5 displays the projected X-ray image of the space distribution of the transmitted X-rays by cathodoluminescence. The X-ray image is maintained on the phosphor screen 5 until a negative potential is applied to the conductive film 6, i.e. an erasing process. Then, another X-ray image can be displayed on the same phosphor screen 5 without any interference with respect to the previously displayed X-ray image.

Figure 3:
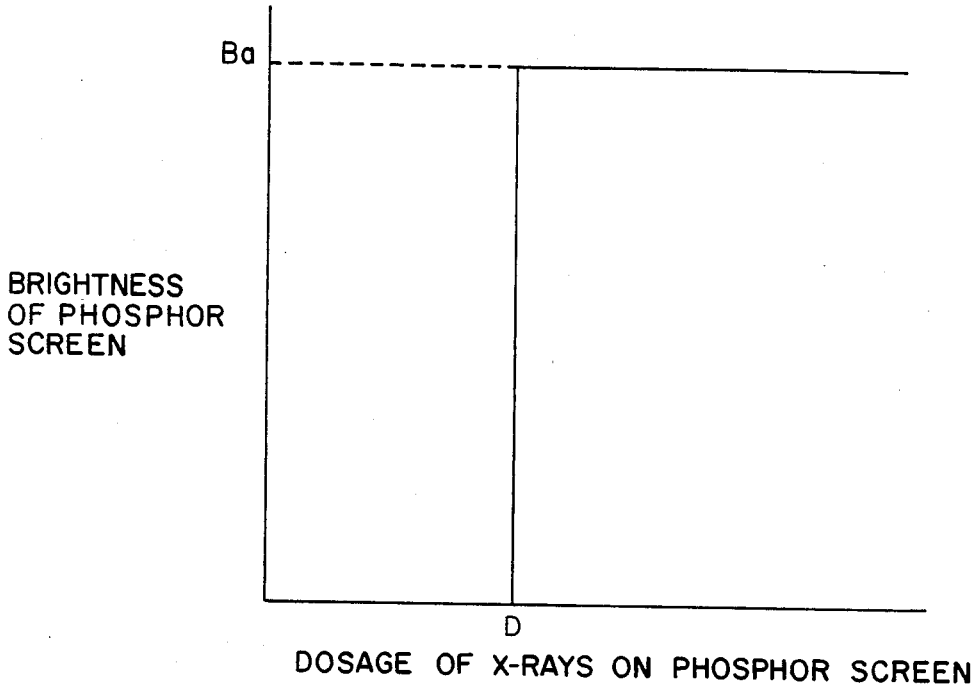
FIG. 3 shows a curve of the brightness of a phosphor screen as a function of the exposure dosage of X-rays on the phosphor screen.

There is a threshold D with respect to the exposed dosage of X-rays needed to depolarize the persistently polarized phosphor crystals. Threshold D can be empirically, but not theoretically, determined by the following procedure. The conductive film 6 has a constant potential $V_a$ after a negative potential (e.g. −300 volts) has been applied. No luminescence or a faint luminescence is observed from the phosphor screen 5. Then, X-rays of various dosages are irradiated on phosphor screen 5 through face plate 7. FIG. 3 shows a typical curve representing the relationship between the depolarization (detected by the cathodoluminescence $B_a$) and the dosages of X-ray exposure. If the phosphor crystals in the phosphor screen absorb a dosage of X-rays which is more than threshold D, the persistently polarized phosphor crystals are depolarized, resulting in the constant cathodoluminescence $B_a$ on the screen. If a dosage which is less than D is irradiated on the phosphor screen, the phosphor crystals remain persistently polarized and no luminescence is observed. The value of the threshold D varies with the kind of phosphors, and with screen conditions.

A brighter cathodoluminescence allows a clear and high contrast X-ray image on the phosphor screen which may allow one to observe the X-ray image on the phosphor screen in a lighted room. The cathodoluminescence intensity $B_a$ of the phosphor screen is determined by the applied voltage $V_a$ of the conductive film 6; the cathodoluminescence intensity increases as the applied voltage is increased. If the applied voltage $V_a$ is near $V_H$, a high cathodoluminescence intensity is expected, but the intensity of the faint cathodoluminescence (i.e.- the background luminescence) is also increased with an increase in $V_a$. Consequently, the contrast of the X-ray image on the phosphor screen, (estimated from the ratio of $B_a$ to the background cathodoluminescence) becomes poor. Thus, a poor contrast X-ray image is obtained when the applied voltage is near $V_H$.

Figure 4:
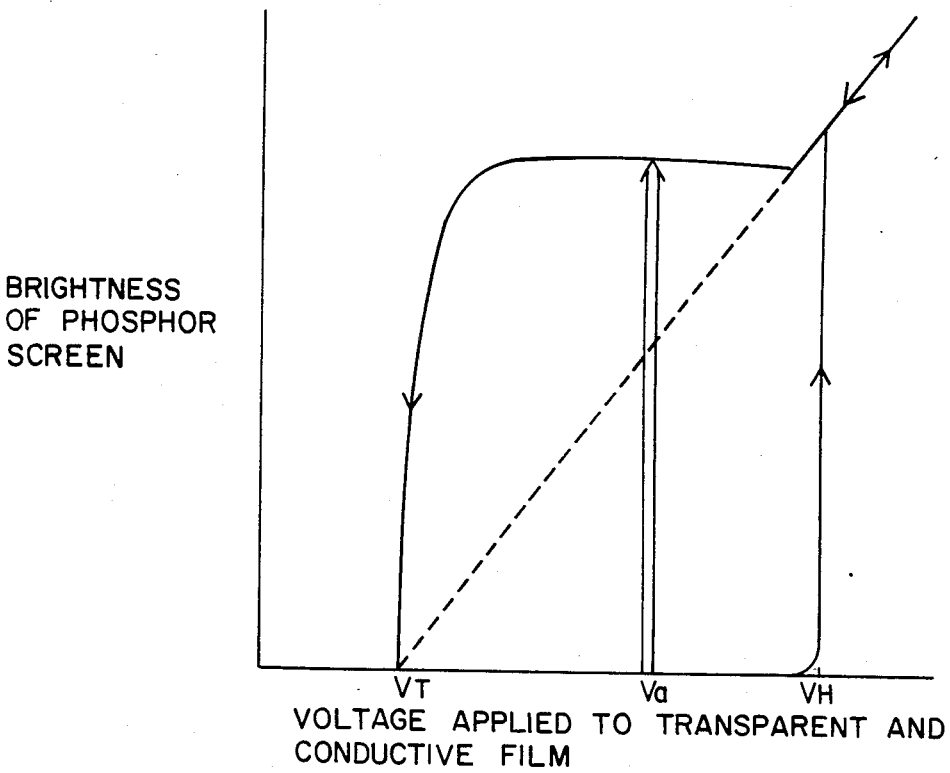
FIG. 4 shows an improved hysteresis curve of cathodoluminescence intensities.

The cathodoluminescence intensity and the contrast of the X-ray image on the phosphor screen are markedly improved if a potential $V_F$ which is slightly below $V_H$ is applied to the first collecting electrode 3. FIG. 4 shows an improved hysteresis curve with the application of $V_F$ to the first collecting electrode 3. It can be seen from FIG. 4 that the concavity of the hysteresis curve does not become affected with the application of $V_F$ to the first collecting electrode 3 (i.e.- the background luminescence intensity does not change with $V_F$) but the cathodoluminescence intensities with a downward going voltage from $V_H$ are markedly changed with the potential applied to the first collecting electrode 3 (i.e.- a convex curve in the hysteresis curve is obtained with $V_F$). If $V_F$ is applied to the first collecting electrode 3, the phosphor screen emits almost constant luminescence intensity in the voltage range between $V_T$ and $V_H$, when the applied voltage at the conductive film 6 is decreased from $V_H$. If a potential greater than $V_H$ is applied to the first collecting electrode 3, a single curve which has a constant intensity between $V_T$ and $V_F$ is obtained instead of the hysteresis curve. Thus, $V_F$ (which is smaller than $V_H$) should be applied to the collecting electrode 3 to obtain the improved hysteresis curve. Because the background cathodoluminescence intensity is more dependent upon the conditions of the phosphor screen and the potential of the conductive film 6, rather than on the potential at the collecting electrode 3, the contrast of the X-ray image on the phosphor screen obtained at a potential $V_a$ of the conductive film 6 is significantly improved (about double in the case of FIG. 4) by the application of $V_F$ to collecting electrode 3. An explanation of the improved hysteresis curve shown in FIG. 4 is that the electrons from cathode 2 are accelerated by the potential $V_F$ at the first collecting electrode 3, rather than the potential at the conductive film 6, and the electrons have an energy of $eV_F$. The potential in front of the phosphor crystals, produced by the persistent polarization of the phosphor crystals, is $eV_H$ which is greater than an energy of $eV_F$. Therefore, electrons having an energy of $eV_F$ cannot penetrate through the shielding field $V_H$ and the electrons which do not reach the phosphor crystals are collected by the first collecting electrode 3. When the persistently polarized crystals are depolarized, electrons having an energy of $eV_F$ reach and penetrate into the phosphor crystals, giving rise to a constant cathodoluminescence intensity between $V_T$ and $V_F$. The threshold voltage $V_T$ is probably determined by the conditions of the phosphor screen; however, the reason for this is not yet clear. Similarly, the improved hysteresis curve is also obtained if the electrons from the cathode 2 are accelerated with the potential $V_F$ being applied to other electrodes, instead of the first collecting electrode 3, e.g.- an anode placed in front of the cathode 2 or a metal mesh placed in front of the phosphor screen 5.

Figure 5:
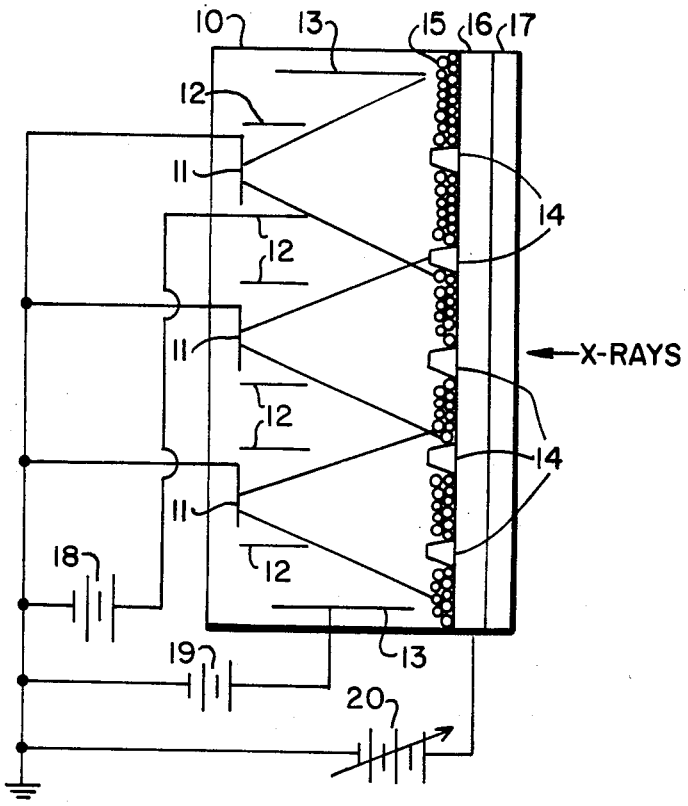
FIG. 5 shows a schematic illustration of a cathode ray tube for directly displaying X-ray images on a phosphor screen, wherein element 10 is an envelope; elements 11 are cathodes; elements 12 are anodes; elements 13 are first collecting electrodes; elements 14 are second collecting electrodes; element 15 is a phosphor screen; element 16 is an optically transparent and electrically conductive film; element 17 is a face plate; elements 18 and 19 are power supplies; element 20 is a variable power supply.

FIG. 5 shows a schematical diagram of a cathode ray tube which is able to display the X-ray images, and illustrated in order to explain the practical operation of the present invention. An optically transparent and electrically conductive thin film 16 of tin oxide containing indium oxide is coated on face plate 17 which is an optically transparent glass that contains no heavy elements (e.g. lead, Pb) having a large absorption coefficient of X-rays. A slurry made from the mixture of a conductive fine powder (e.g.- carbon, iron oxide and the like) and photosensitized polyvinyl alcohol is uniformly coated on the conductive film 16. The dried slurry layer is exposed under ultraviolet light through a mesh having holes with a diameter of 100 micrometers, said mesh being placed in front of the face plate 17. The exposed layer is developed with warm water to form the second collecting electrodes 14 on the conductive film 16. Then, the slurry of the phosphor crystals (e.g. gadolinium oxysulfide activated with terbium, $Gd_2O_2S$:Tb) and photosensitized polyvinyl alcohol is uniformly coated on the conductive film 16 having the second collecting electrodes 14, and the dried layer is exposed to the ultraviolet light from face plate 17. The exposed phosphor screen is developed with warm water. We then obtain a phosphor screen 15 resulting from the phosphor crystals lying down in the areas of the conductive film 16 on which the collecting electrodes 14 have not been formed.

Face plate 17, which has the phosphor screen 15 and second collecting electrodes 14, is mounted in envelope 10 containing cathodes 11, anodes 12, and second collecting electrodes 13. When ordinary cathode ray tube fabrication processes have been carried out, the device which is schematically shown in FIG. 5 is obtained. In this device, the hysteresis curve shown in FIG. 2 is obtained between 110 and 210 volts after a negative potential (e.g. −300 volt) has been applied to the conductive and transparent film 16 for 1 millisecond, anodes 12 having 90 volts applied thereto and the first collecting electrodes 13 having 100 volts applied thereto. The improved hysteresis curve shown in FIG. 4 is obtained in the voltage range between 110 and 210 volts, if anodes 12 have 180 volts applied thereto, the first collecting electrodes 13 have 140 volts applied thereto and the conductive film 16 has been supplied with minus 300 volts for 1 millisecond. In order to demonstrate the display of X-ray images on the phosphor screen, the cathode ray tube should be set for the following conditions: the cathodes 11 are grounded, the anodes 12 have 180 volts applied thereto, the first collecting electrodes 13 have 150 volts applied thereto, the transparent and conductive film 16 has 160 volts applied thereto after −300 volts has been applied to the conductive film 16 for 1 millisecond. The phosphor screen in the device emits no luminescence or a faint luminescence under the above conditions. If X-rays irradiate the phosphor screen through face plate 17 for a moment, the exposed phosphor screen allows the reaching of the electrons from the cathodes 11 and emits cathodoluminescence. If a human body stands between the X-ray source and the X-ray image device, the latent X-ray image of the inside of the body is recorded on the phosphor screen 15, and the phosphor screen 15 continuously displays the X-ray image on the phosphor screen 15 until the latent X-ray image has been erased by the application of a negative potential to the transparent and conductive film 16. This means that the latent X-ray image recorded in the phosphor screen does not fade with time and the X-ray image device can continuously and intermittently display an X-ray image on the phosphor screen until the latent X-ray image on the phosphor screen is erased. The cathodoluminescence intensity from the phosphor screen is bright enough to observe the X-ray image on the phosphor screen in a room illuminated with regular lighting, instead of in a dark or dimly lit room. When the erasing process has been applied to the phosphor screen, the latent X-ray image is completely erased from the phosphor screen, and the phosphor screen in the X-ray image device is restored to record other X-ray images on the phosphor screen.

However, the keeping and referring occasionally to the X-ray images of patients is essential to the operation of hospitals and clinics. To respond to these requirements, the X-ray images by cathodoluminescence or latent X-ray images on the phosphor screen should be output from the phosphor screen, and recorded onto recording media (e.g. a memory in computers) before the application of the erasing process of the phosphor screen.

The easiest way to record the X-ray image on the phosphor screen, which are produced by the steady cathodoluminescence, may be by reading same with the image tube for one frame. A more reliable way would be the monitoring of a change in the electrical current of the first or second collecting electrodes.

Figure 6:
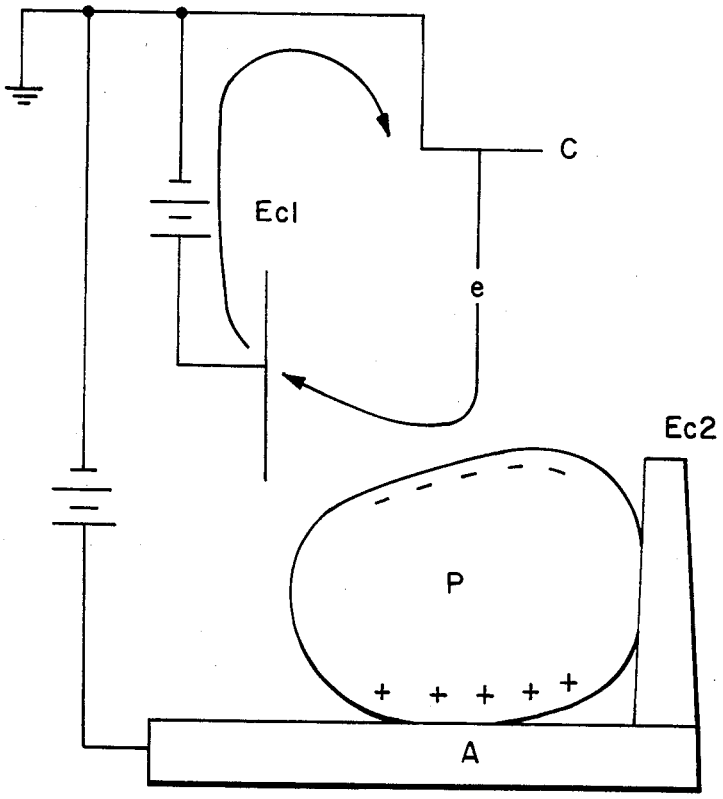
FIG. 6 shows a schematic illustration for explaining the electron flow in a cathode ray tube when its phosphor crystals are persistently polarized, wherein element C is a cathode; elements e are electrons; element $E_{C1}$ is a first collecting electrode; element $E_{C2}$ is a second collecting electrode; element P is a phosphor crystal; element A is a transparent and conductive film.
Figure 8A:
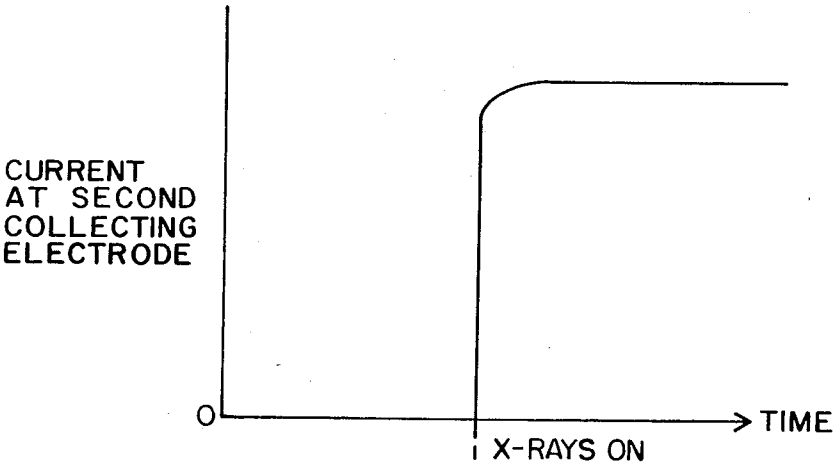
FIGS. 8*a* and 8*b* show the change in currents at first and second collecting electrodes before and after X-rays irradiate the persistently polarized phosphor screen.
Figure 8B:
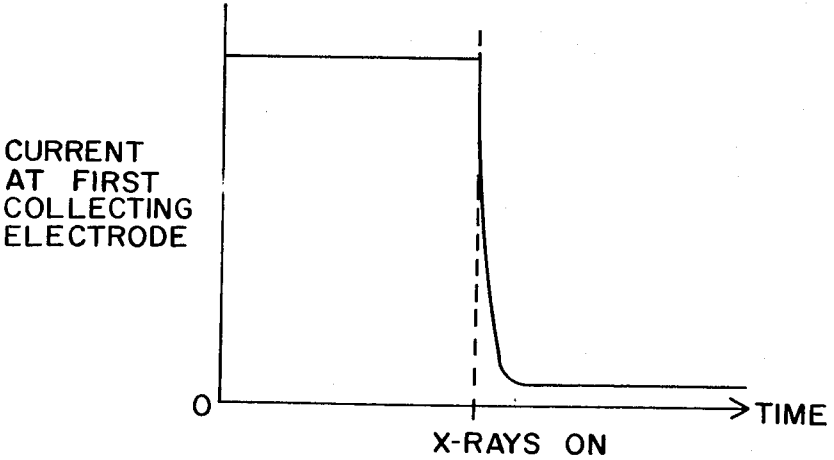
Figure 7:
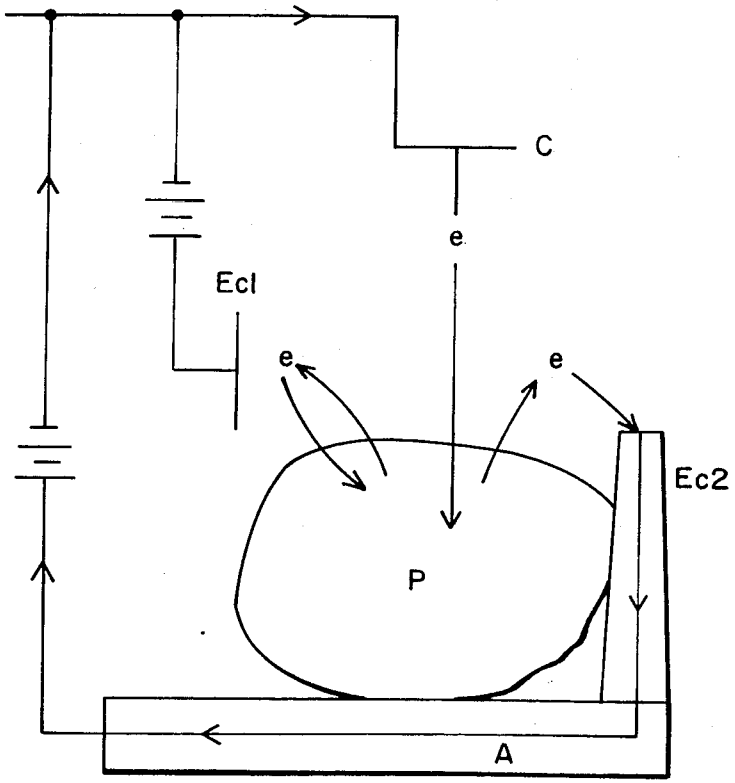
FIG. 7 shows a schematic illustration for explaining the electron flow in a cathode ray tube when its phosphor crystals are depolarized, wherein element C is a cathode; elements e are electrons; element $E_{C1}$ is a first collecting electrode; element $E_{C2}$ is a second collecting electrode; element P is a phosphor crystal; element A is a transparent and conductive film.

As already described, most of the electrons from the cathode are collected by the first collecting electrode if the phosphor crystals in the phosphor screen are persistently polarized, and the second collecting electrode does not collect (or collects a small amount of) the electrons, as schematically shown in FIG. 6. When the phosphor crystals are depolarized, the electrons from the cathode reach and penetrate into the phosphor crystals, generating and emitting the true secondary electrons with the ratio of a few true secondary electrons per one entered electron. The second collecting electrode $E_{C2}$ collects an amount of true secondary electrons which is equal to the amount of electrons entering into the phosphor crystals, and the residual electrons reenter into the phosphor crystals, as schematically shown in FIG. 7, and the first collecting electrode $E_{C1}$ collects no electrons or a very small amount of the electrons. Thus, in the cathode ray tube, the electrons starting from the cathode make a closed circuit at the phosphor screen via the true secondary electrons, instead of passing through the phosphor crystals as has been considered traditionally, and back to cathode through the collecting electrode and circuit outside of the tube so as to make a complete closed circuit. FIGS. 8*a* and 8*b* show the change in electrical current detected at first ($i_1$) and second ($i_2$) collecting electrodes, before and after X-rays expose the entire phosphor screen.

However, the X-ray image on the phosphor screen cannot be detected by a simple reading of the change in the current of the collecting electrodes. To detect the X-ray image on the phosphor screen, the phosphor screen should be addressed, and the reading of the change in the current of the collecting electrodes should be synchronized with the scanning of the address of the corresponding location on the phosphor screen. The addressing on the phosphor screen can be made by the scanning of a sharply focused electron beam from a second electron gun (i.e.- a reading gun) from which the electrons are accelerated with voltage greater than $V_H$ shown in FIG. 2, but the beam power (i.e.- a product of the accelerating voltage and beam density) should be small so as to avoid the depolarization of the persistently polarized phosphor crystals.

The resolution of the X-ray image taken from the phosphor screen is determined by the beam size of the electron beam from the reading gun; a small size results in a better recorded X-ray image. The size of the phosphor crystals of the phosphor screen is about 10 micrometers and this limits the highest resolution. Therefore, a good result will be obtained with the size of the electron beam from the reading gun being between 10 and 300 micrometers, and more preferably between 20 and 100 micrometers, and most preferably between 30 and 60 micrometers. The electron beam is more easily focused with a high accelerating voltage, but a higher voltage needs a good electrical insulator to prevent the breakdown of the electrical circuits. This will limit the upper voltage of the accelerating voltage of the reading gun. Therefore, the accelerating voltage of the electron beam from the reading gun is preferably higher than 500 volts but smaller than 30 kilovolts, and more preferably between 1 and 10 kilovolts, and most preferably around 5 kilovolts.

There is, as already described, a threshold dosage of X-rays, electron beams or photons having an energy which is greater than the band gap in order to depolarize the persistently polarized phosphor crystals. All of the radiation types mentioned above generate electron-hole pairs in the phosphor crystals when they penetrate into the crystals. It can be more precisely said that the threshold of the depolarization is determined by the number of electron hole pairs generated in the phosphor crystals per unit time. The threshold number of the electron-hole pairs for the depolarization is theoretically unclear, and has been empirically determined. It is found that the scanning of an electron beam which has a 5 kV accelerating voltage and a 100 $\mu$m beam size, on the persistently polarized phosphor screen, results in polarized crystals which are not depolarized if the electron beam current is between 0.001 and 1 $\mu$A, and preferably between 0.01 and 0.7 $\mu$A, and most preferably around 0.3 $\mu$A.

Figure 9:
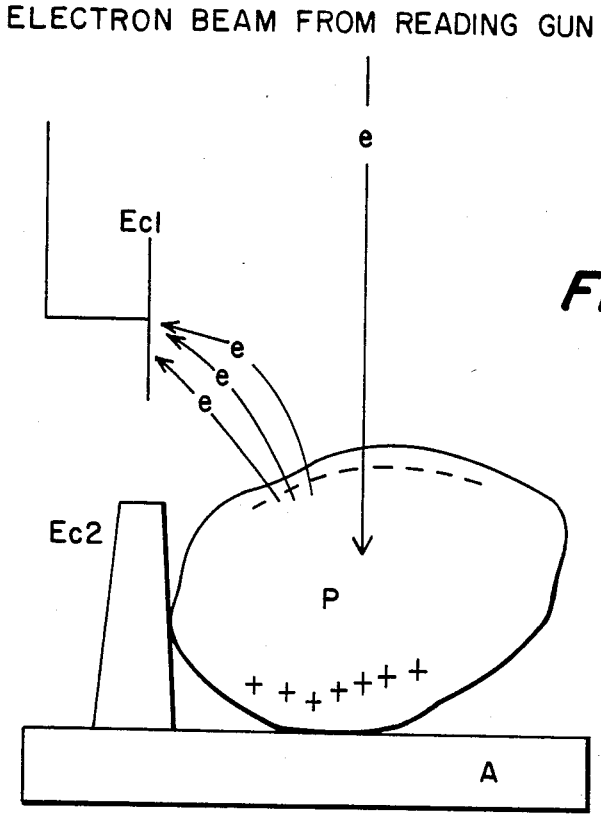
FIG. 9 shows a schematic illustration for explaining the electron flow in a cathode ray tube having true secondary electrons which are emitted from the persistently polarized phosphor crystals, wherein elements e are electrons; element $E_{C1}$ is a first collecting electrode; element $E_{C2}$ is a second collecting electrode; element P is a phosphor crystal; element A is a transparent and conductive film.
Figure 10:
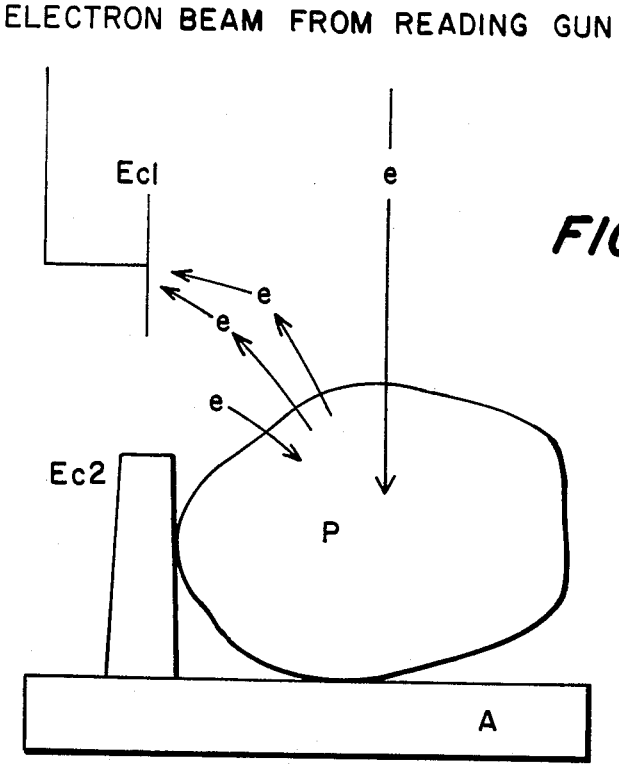
FIG. 10 shows a schematic illustration for explaining the electron flow in a cathode ray tube having true secondary electrons which are emitted from the depolarized phosphor crystals, wherein elements e are electrons; element $E_{C1}$ is a first collecting electrode; element $E_{C2}$ is a second collecting electrode; element P is a phosphor crystal; element A is a transparent and conductive film.

When the reading electron beam is irradiated on the phosphor screen, for displaying the X-ray image, the electric currents of the first and second collecting electrodes, $E_{C1}$ and $E_{C2}$ are changed with the period of irradiation of the reading electron beam on the X-ray images on the phosphor screen. When the reading electron beam is irradiated on the persistently polarized phosphor crystal, as schematically shown in FIG. 9, the electron beam may penetrate into the phosphor crystal, and the crystal emits the true secondary electrons and a faint cathodoluminescence. The emitted true secondary electrons are repulsed by the negative field produced by the persistent polarization of the phosphor crystal and most of them are collected by the first collecting electrode $E_{C1}$. When the phosphor crystals are depolarized, the reading electron beam also penetrates into the phosphor crystals, emitting the faint cathodoluminescence and the true secondary electrons, as schematically shown in FIG. 10. In this case, some of the emitted secondary electrons reenter into the phosphor crystal by the attraction of the holes generated in the phosphor crystal by the emission of the true secondary electrons. The residual electrons of the true secondary electrons are collected by either the first collecting electrode $E_{C1}$ or second collecting electrode $E_{C2}$. Therefore, the electrical current of the first collecting electrode $E_{C1}$ is decreased during the period of the scanning of the reading electron beam on the phosphor crystals which have been depolarized. If the electric current of the second collecting electrode $E_{C2}$ is detected, the current is increased during the period of the scanning of the reading electron beam on the phosphor crystal which have been depolarized.

Therefore, the change of the electric current of the collecting electrodes is synchronously detected during the scanning of the reading electron beam on the phosphor screen, and the X-ray image on the phosphor screen can be detected remotely from the cathode ray tube. The image information taken from the phosphor screen can be recorded and stored in ordinary memory media, such as magnetic tape, magnetic disks, optical disks, electonic memories and the like. The recorded image information can occasionally be output from the recorded media, and displayed on the phosphor screen of an ordinary cathode ray tube for diagnosis or reference purposes by doctors in hospitals and clinics, and by inspectors in quality control areas of manufacturing.

Figure 11:
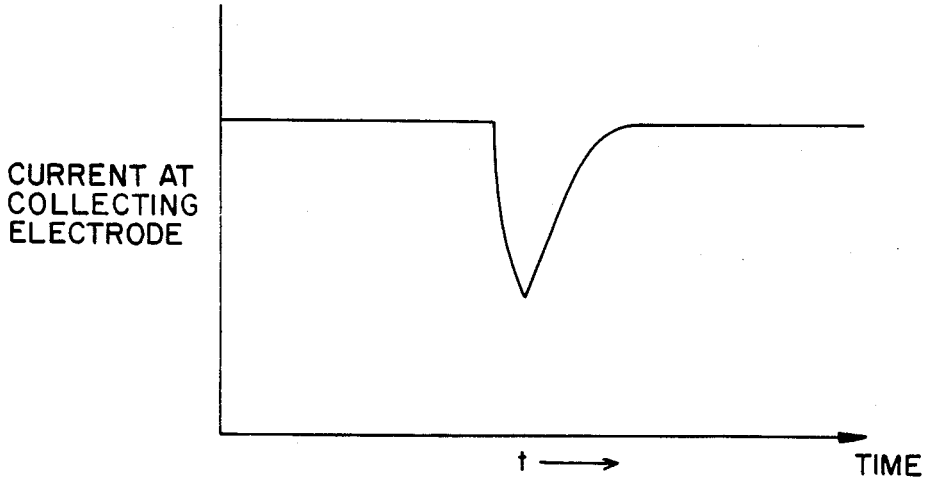
FIG. 11 shows a change in current at a collecting electrode when the reading electron beam scans the depolarized phosphor crystals.

As noted above, the change in the electric current of the collecting electrodes is synchronously detected during the scanning of the reading electron beam on the phosphor screen and the X-ray image displayed on the phosphor screen can be detected remotely from the cathode ray tube. FIG. 11 illustrates the wave form of the change in current at a collecting electrode when the reading electron beam scans the depolarized phosphor cyrstals.

Figure 12:
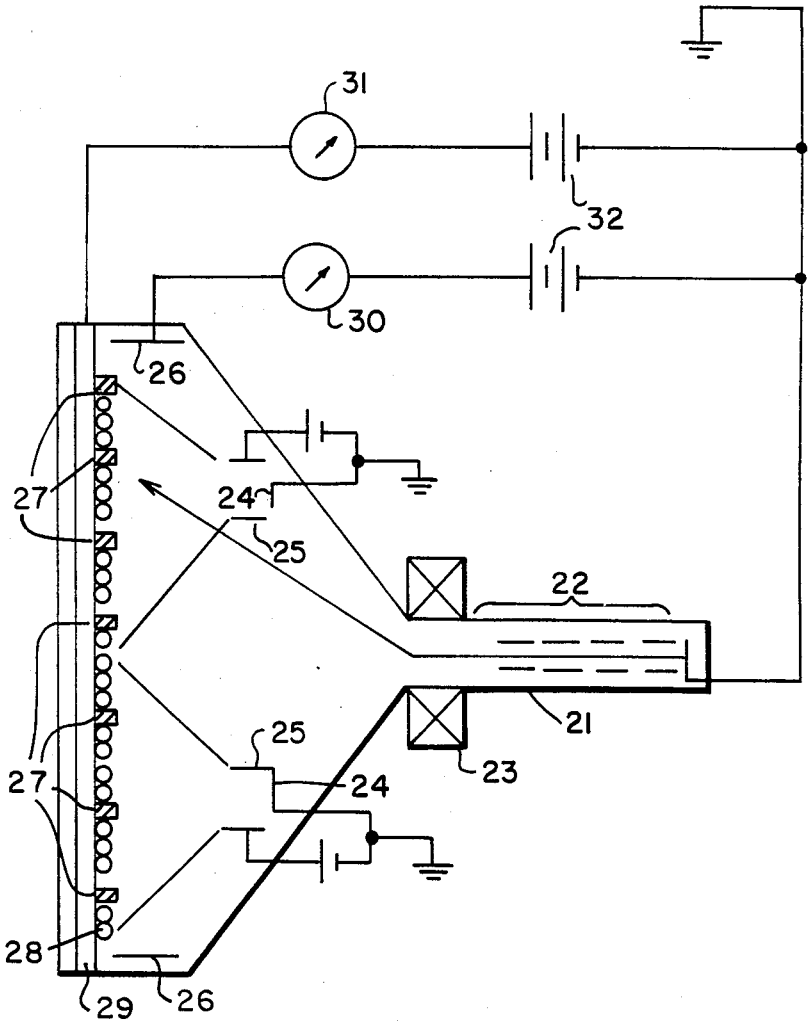
FIG. 12 shows a schematic illustration of a cathode ray tube for directly displaying X-ray images on a phosphor screen, wherein the X-ray image on the phosphor screen is read out by the reading electron beam, wherein element 21 is an envelope; element 22 is a reading electron gun; element 23 is a deflection coil for the reading electron beam; elements 24 are cathodes; elements 25 are anodes; elements 26 are first collecting electrodes; elements 27 are second collecting electrodes; element 28 is a phosphor screen; element 29 is an optically transparent and electrically conductive film; elements 30 and 31 are current meters; elements 32 are power supplies.

FIG. 12 illustrates a concrete example of an application of the present invention to a cathode ray tube.

It is noted that elements 30 and 31 are illustrated symbolically as current meters. In fact, in actual usage these element would be current detecting devices which would be utilized to generate current signals corresponding to that illustrated in FIG. 11 of the drawing figures.

In operation, the deflection coil 23 can be used to control the reading beam emitted by the reading electron gun 22 in a fashion which is exactly analogous to that of the operation of a standard commercial TV picture tube and accordingly, a detailed description of the control thereof has been omitted.

Similarly, the correlation of the currents detected by elements 30 and 31 with the position of the reading electron beam generated by the electron gun 22 as controlled by the deflection coil 23 is also known to those skilled in the art and therefore has been omitted.

Although the present invention has been fully described by way of examples with reference to the accompanying drawings, it is to be noted that various changes and modifications will be apparent to those skilled in the art and accordingly, unless such changes and modifications depart from the true scope of the present invention, they should be construed as being included therein.

I claim:

1. An X-ray imaging device for directly displaying X-ray images on a screen, comprising:

a layer of phosphor crystals arranged on said screen;

at least one cathode for emitting electrons which impinge on said phosphor screen, said crystals being excited by said electrons so as to display said X-ray image by a steady cathodoluminescence;

wherein said phosphor crystal excitation is controlled by the persistent polarization and depolarization thereof, said crystals emitting said steady cathodoluminescence only when depolarized and said crystals comprising a material which is depolarized when X-rays irradiate said persistently polarized crystals.

2. An X-ray image device according to claim 1, wherein said phosphor screen is continuously and uniformly irradiated by electrons which are emitted from said at least one cathode and which have been accelerated by a potential in a predetermined voltage range subsequent to the momentary application of a negative electric field which has been applied across said phosphor screen; wherein, when X-rays momentarily irradiate said phosphor screen, the areas of said phosphor screen which have been irradiated by said X-rays continuously emit cathodoluminescence until said negative electric field is again momentarily applied across said phosphor screen.

3. An X-ray imaging device according to claim 2, further comprising a means for deriving a time varying signal corresponding to said displayed X-ray images, said means for deriving including a means for generating and controlling a read electron beam which is scanned over said phosphor screen and including a current detecting means for generating a signal corresponding to current flowing in collecting electrodes which are disposed in said device, wherein said signal generated by said current detecting means comprises said time varying signal.

4. An X-ray imaging device according to claim 1, wherein said cathodoluminescence intensity and X-ray image contrast on said phosphor screen are improved by application of a predetermined potential to one of either collecting electrodes, electrodes which are placed in front of said at least one cathode, or electrodes placed in front of said phosphor screen.

5. An X-ray imaging device according to claim 4, further comprising a means for deriving a time varying signal corresponding to said displayed X-ray images, said means for deriving including a means for generating and controlling a read electron beam which is scanned over said phosphor screen and including a current detecting means for generating a signal corresponding to current flowing in collecting electrodes which are disposed in said device, wherein said signal generated by said current detecting means comprises said time varying signal.

6. An X-ray imaging device according to claim 1, wherein said phosphor screen is placed on a face plate and comprises a powder of phosphor crystals which emit brilliant cathodoluminescence when incident electrons have penetrated thereinto, and which are persistently polarized when an external electric field has been applied thereto and which are depolarized when subsequently irradiated by X-rays.

7. An X-ray imaging device according to claim 6, wherein said face plate of said device comprises a glass plate which has a low X-ray absorption coefficient.

8. An X-ray imaging device according to claim 6, wherein said phosphor crystals comprise an oxide, oxysulfide, oxyhalide, aluminate, silicate, or halide of at least one element selected from gadolinium, lanthanum, yttrium and lutetium, which has been activated with at least one element selected from terbium, praseodymium, cerium, europium, dysprosium, and samarium.

9. An X-ray imaging device according to claim 6, wherein said phosphor crystals comprise zinc sulfide or zinc-cadmium sulfides containing one of either copper or silver as an activator and one of either a group III-a or a VII-a element as a coactivator.

10. An X-ray imaging device according to claim 6, wherein said phosphor crystals comprise zinc silicate which has been activated with one of either manganese or calcium tungstate.

11. An X-ray imaging device according to claim 6, further comprising a means for deriving a time varying signal corresponding to said displayed X-ray images, said means for deriving including a means for generating and controlling a read electron beam which is scanned over said phosphor screen and including a current detecting means for generating a signal corresponding to current flowing in collecting electrodes which are disposed in said device, wherein said signal generated by said current detecting means comprises said time varying signal.

12. An X-ray imaging device according to claim 1, wherein said phosphor screen is placed on a face plate and comprises a thin film of phosphor crystals which emit brilliant cathodoluminescence when incident electrons have penetrated thereinto, and which are persistently polarized when an external electric field has been applied thereto and which are depolarized when subsequently irradiated by X-rays.

13. An X-ray imaging device according to claim 12, wherein said phosphor crystals comprise an oxide, oxysulfide, oxyhalide, aluminate, silicate, or halide of at least one element selected from gadolinium, lanthanum, yttrium and lutetium, which has been activated with at least one element selected from terbium, praseodymium, cerium, europium, dysprosium, and samarium.

14. An X-ray imaging device according to claim 12, wherein said phosphor crystals comprise zinc sulfide or zinc-cadmium sulfides containing one of either copper or silver as an activator and one of either a group III-a or a VII-a element as a coactivator.

15. An X-ray imaging device according to claim 12, wherein said phosphor crystals comprise zinc silicate which has been activated with one of either manganese or calcium tungstate.

16. An X-ray imaging device according to claim 12, wherein said face plate of said device comprises a glass plate which has a low X-ray absorption coefficient.

17. An X-ray imaging device according to claim 1, wherein said phosphor crystals comprise an oxide, oxysulfide, oxyhalide, aluminate, silicate, or halide of at least one element selected from gadolinium, lanthanum, yttrium and lutetium, which has been activated with at least one element selected from terbium, praseodymium, cerium, europium, dysprosium, and samarium.

18. An X-ray imaging device according to claim 1, wherein said phosphor crystals comprise zinc sulfide or zinc-cadmium sulfides containing one of either copper or silver as an activator and one of either a group III-a or a VII-a element as a coactivator.

19. An X-ray imaging device according to claim 1, wherein said phosphor crystals comprise zinc silicate which has been activated with one of either manganese or calcium tungstate.

20. An X-ray imaging device according to claim 1, further comprising a means for deriving a time varying signal corresponding to said displayed X-ray images, said means for deriving including a means for generating and controlling a read electron beam which is scanned over said phosphor screen and including a current detecting means for generating a signal corresponding to current flowing in collecting electrodes which are disposed in said device, wherein said signal generated by said current detecting means comprises said time varying signal.

* * * * *